United States Patent [19]

Arnold

[11] Patent Number: 5,060,123

[45] Date of Patent: Oct. 22, 1991

[54] FLASHLIGHT CARRYING BATON

[75] Inventor: Charles S. Arnold, Bay St. Louis, Miss.

[73] Assignee: LETD, Inc., New Orleans, La.

[21] Appl. No.: 695,015

[22] Filed: May 3, 1991

[51] Int. Cl.[5] ..... A63B 15/02

[52] U.S. Cl. ..... 362/102; 362/109; 362/190; 362/208; 273/84 R

[58] Field of Search ..... 273/84 R, 84 ES, 84 A; 362/102, 109, 186, 187, 190, 208

[56] References Cited

U.S. PATENT DOCUMENTS

| | | | |
|---|---|---|---|
| 1,183,282 | 5/1916 | Dinjce | 273/84 R |
| 2,242,981 | 5/1941 | Pedersen | 362/102 |
| 2,257,227 | 9/1941 | Dater | 362/102 |
| 2,260,639 | 10/1941 | Powell | 362/102 |
| 3,383,675 | 5/1968 | Allardice et al. | 362/186 |
| 3,737,649 | 6/1973 | Nelson et al. | 362/102 |
| 4,479,171 | 10/1984 | Mains | 362/102 |
| 4,486,807 | 12/1984 | Yanez | 273/84 ES |
| 4,697,228 | 9/1987 | Mui et al. | 362/208 |
| 4,744,013 | 5/1988 | Lee et al. | 362/109 |
| 4,819,137 | 4/1989 | Hamilton | 362/102 |

*Primary Examiner*—Ira S. Lazarus
*Assistant Examiner*—Sue Hagarman
*Attorney, Agent, or Firm*—Dowell & Dowell

[57] ABSTRACT

A policeman's billy includes a tube having rotatably connected front and rear sections. The head of a twist-on flashlight is resiliently mounted in the upper section and its body extends into the lower section and is connected mechanically thereto so that relative twisting movement of the two sections changes the flashlight beam from a spot to flood and also turns the light off and on.

11 Claims, 2 Drawing Sheets

FLASHLIGHT CARRYING BATON

BACKGROUND OF THE INVENTION

1. Field of the Invention

This invention relates to a policeman's billy or baton. In particular to a baton adapted to carry a standard twist-on flashlight.

2. History of the Related Art

A policeman's billy having a built-in flashlight has been described in various patents. These include the U.S. Pat. Nos. to Dater 2,257,227, Powell 2,260,639, Nelson et al. 3,737,649, Mains 4,479,171, and Hamilton 4,819,137.

In the patents to Dater and Powell the cap of the billy may be removed for access to the inner works of the flashlight. Similarly, in the patents to Nelson and Mains the cap and the rear end of the baton are removable.

The patent to Hamilton discloses a baton in which the light at the end is turned on and off by twisting of the cap.

The patent to Mains also discloses a side handle for the baton.

SUMMARY OF THE INVENTION

It is an object of the invention to provide a baton for holding a standard twist-on flashlight which is protectively carried to resist shock and moisture within the baton and which can be easily removed or the batteries replaced without removing it from the baton.

The flashlight can be readily focused from a spot to flood mode. The length of the baton may be extended if desired for use in riot work. In addition, the baton provides a storage space for police accessories such as plastic handcuffs of the type used by policemen.

DESCRIPTION OF THE PREFERRED EMBODIMENT

Figure 1:
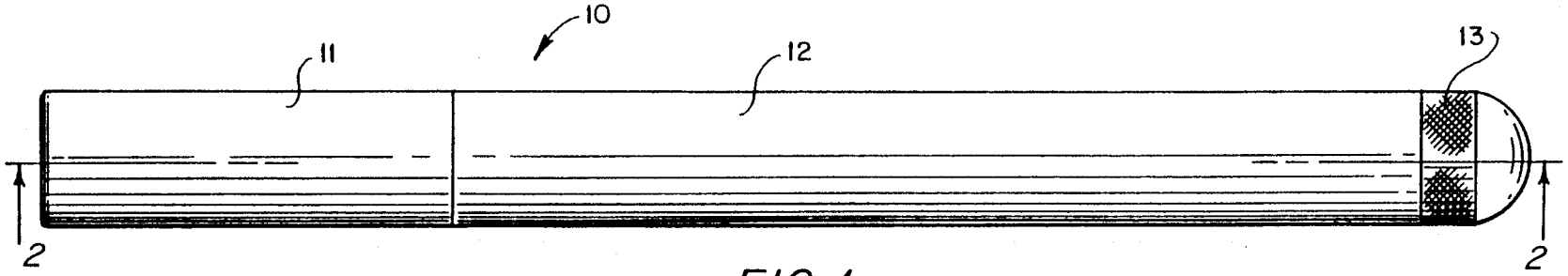
FIG. 1 is a plan view of a preferred embodiment.
Figure 2:
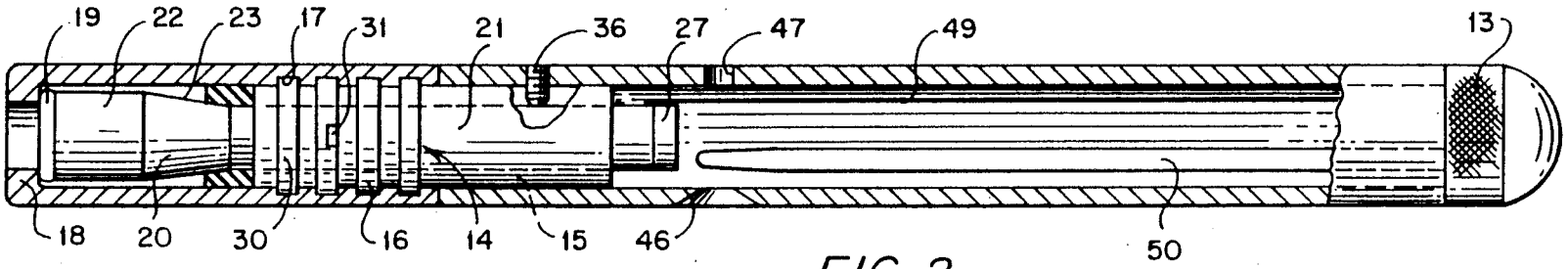
FIG. 2 is a section on the line 2—2 of FIG. 1 with a flashlight included and with some parts in elevation.
Figure 5:
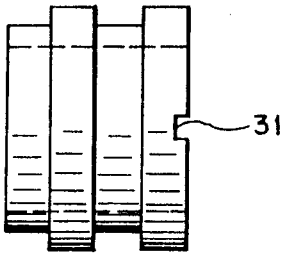
FIG. 5 is an enlarged elevation of the bushing for urging the grommet into engagement with the flashlight head.
Figure 4:
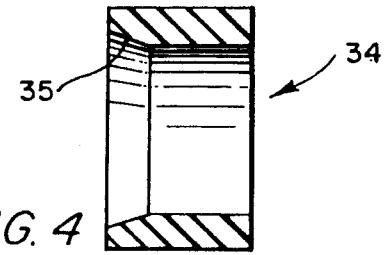
FIG. 4 is an enlarged section of the grommet for holding the head of the flashlight.
Figure 3:
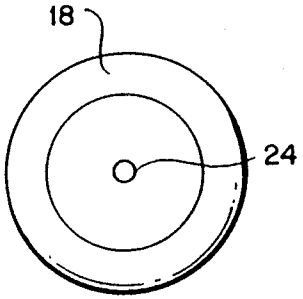
FIG. 3 is a front end view.

The baton of the present invention includes a tube 10 having a forward portion 11 and rearward portion 12 of uniform diameter with a threaded end plug 13. In order to connect these together a connector member 14 has a rearward portion 15 that is received snugly, as for example with a press fit, within the forward end portion of the rearward tube portion 12. The connector has a forwardly extending portion 16 carrying threads which are preferably of the square cut type. The rearward end portion of the forward tube 11 is provided with internal threads 17 for receiving the threads 16 of the connector 14. Its forward end has an in-turned flange 18 and 0-ring 19 for engaging the front end of a flashlight 20.

The mini-flashlight 20 is adapted to be received and carried within the tube assembly 10. The flashlight has a slender rear body 21 and a head 22 with a tapered neck portion 23. The flashlight carries a small high intensity bulb 24 that is powered by standard AA size batteries (not shown) carried in the body 21. The bulb is turned off and on and its beam focus changed by twisting the body 21 with respect to the head 22. An example of a suitable flashlight bears the mark MINI-MAGLITE, manufactured by Mag Instruments, Ontario, Calif.

In order to mount the flashlight within the tube, a bushing 30 is provided having threads that are received within the internal threaded portion 17 of the tube 11 and which has indentations 31 for receiving the end protrusions 32 of a barrel shaped spanner wrench 33 in order to place and remove the bushing from the interior of the tube portion 11. In order to firmly engage the neck portion of the flashlight against rotation and absorb shock a grommet 34 having a tapered end portion 35 is provided which is of resilient material and which abuts the end portion of the bushing. Thus, the flashlight is initially mounted within the forward tube portion 11 by placing the grommet 34 and the bushing around the body of the flashlight and then securing it firmly within the tube portion 11 by rotation of the bushing 30. The rear portion 12 of the tube is then threadingly engaged with the connector 14 extending from the forward portion of the tube until the ends abut. Then an interengaging member or set screw 36 is tightened into its recess to engage the body of the flashlight in order to hold it against rotation in the rear portion 50.

Accordingly, with the flashlight thus mounted rotation of the forward and rear portions of the tube in a direction to back off the rear portion from the front portion causes the flashlight to turn on. In addition, the flashlight may be of the type which has a variable spot feature and whose focus may be adjusted as desired.

The flashlight also has a threadingly engaged plug 27 at its rear which provides access to the batteries within the body of the flashlight.

Thus, when it is necessary to replace the flashlight batteries the set screw 36 is loosened and the two sections 11 and 12 are separated by rotative motion thereby permitting access to the rear portion of the flashlight and without removing the forward portion of the flashlight from the tube portion 11.

Figures 6, 7:
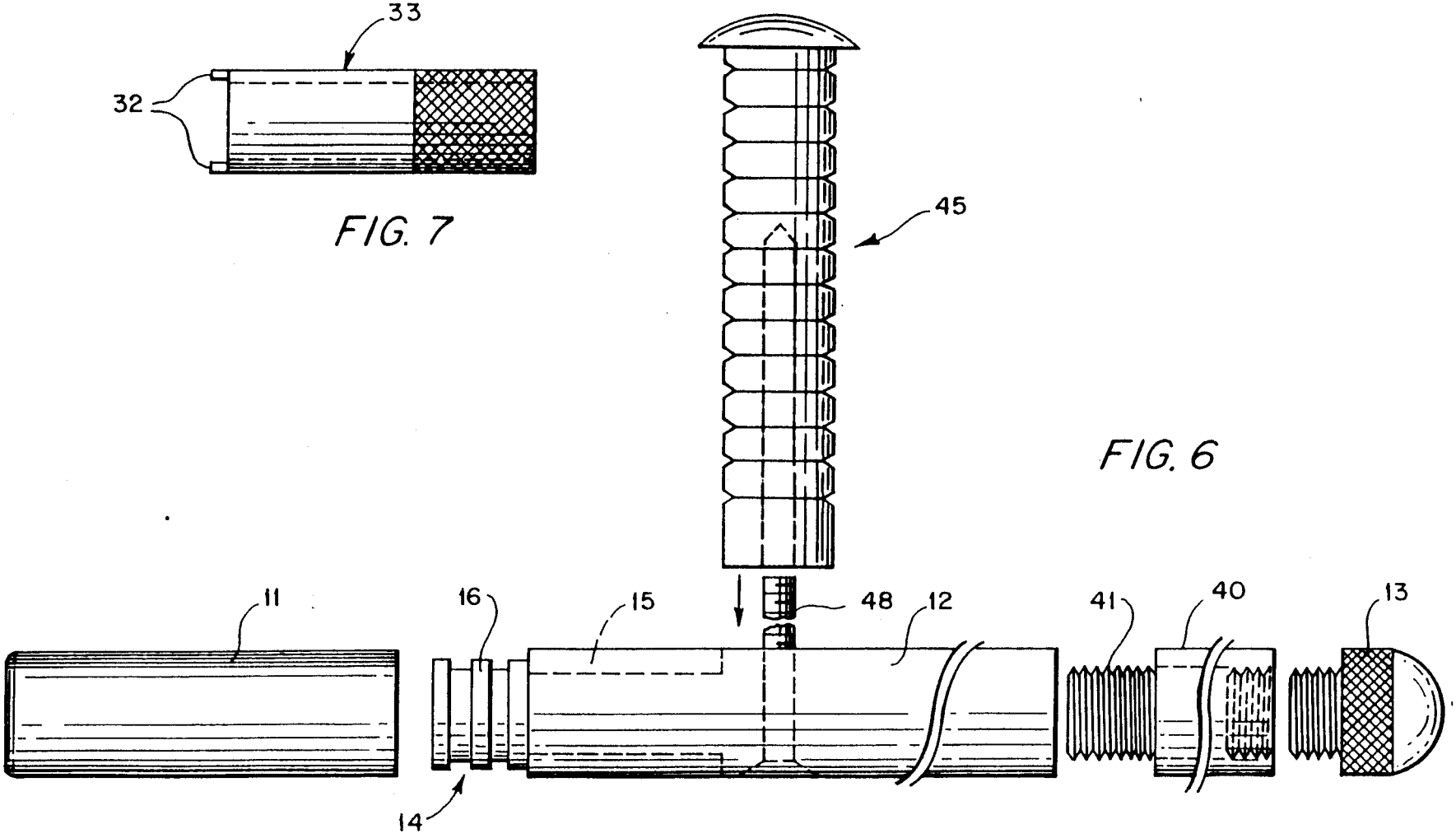
FIG. 6 is an exploded view of the baton of FIG. 1 with an added extension and side handle, with the flashlight omitted.
FIG. 7 is a side elevation of the spanner tool for placing and removing the bushing of FIG. 5.

In the event that an extension of the length of the baton is desired an extension member 40 is provided (see FIG. 6) which has an external threaded portion 41 at its forward end which is received within internal end threads in the rear tube portion 12 when the plug 13 is removed, such plug then being engaged with the rear portion of the extension.

A side handle 45 is connected to the body portion 12 through the openings 46 and 47 by means of a fastening member 48.

The rear of the tube member 12 has space 49 of a length for receiving a substantial number of plastic handcuffs 50 of the type commonly used by policemen.

The front end portion of the tube 11 with its radially in-turned end and 0-ring against which the end of the head flashlight is received provides a secure and relatively water resistant and shock proof mounting for the flashlight, when coupled with the resilient mounting of the member 34 and the fixing by the set screw 36.

Accordingly it will be seen that the present invention includes a baton mounting for a small separate flashlight of the kind which provides a brilliant source of focusable light, and the mounting being such that the flashlight is securely mounted and protected against shock and moisture. The baton has no protruding parts which might be grasped by a suspect or which might inflict unnecessary injury on a suspect. In addition, it is adaptable for adjustment in length, for storage of accessories such as plastic handcuffs.

What is claimed:

1. A baton for use with a twist on-off flashlight, comprising an elongated tube, said tube having front and rear portions, said rear portion having a rotatably engagable portion extending axially at the front of said rear portion, said front portion having a rotatably engagable rear portion extending axially and adapted to engage the engagable front portion of said rear portion, whereby the front and rear portions of said tube may be rotatably assembled, said flashlight having a tubular body portion and a head portion of a size to be received within said tube, said flashlight body being rotatable relative to its head in order to turn the flashlight off and on, means for receiving the body of said flashlight and abutting its head portion and engaging the tube's front portion to hold the flashlight head against movement relative to the front portion of said tube, means for interengaging said flashlight tubular body and said tube's rear portion in order to hold the body against movement relative to the rear portion of said tube, whereby relative rotation of said front and rear portions of said tube causes relative rotation between the flashlight body and its head in order to turn the flashlight off and on.

2. The invention of claim 1 in which the relative rotation of the body portion and head portion also changes the focus of the flashlight.

3. The invention of claim 1, said front portion of said tube having a forward end portion, said forward end portion having radially inwardly extending ledge means, and an 0-ring engaging said ledge means within said forward end portion and abutting the head portion of said flashlight.

4. The invention of claim 1 in which the rotatably engagable portion of said rear portion is a separate connector snugly received within the front of said rear portion of said tube and having a threaded portion extending forwardly thereof and the rotatably engagable portion of said front portion comprises internal threads.

5. The invention of claim 2 in which the head portion of the flashlight has a tapered neck portion, and in which the means for receiving the body of said flashlight includes a resilient insert of a size to receive the body portion of said flashlight and abut the tapered neck portion.

6. The invention of claim 5 in which the means for receiving the body of said flashlight also includes a bushing having threads to engage the threaded portion of said tube's front portion, said bushing being engageable with said threaded portion in order to urge said resilient insert into engagement with said neck portion of said flashlight.

7. The invention of claim 1 in which said flashlight has a battery chamber for battery means and a removable rear end closure which permits access to its battery chamber, and said means interengaging said flashlight body and said rear portion of said tube is releasable, whereby when the front and rear portion of said tube are disassembled the closure may be removed to permit changing of battery means within said chamber.

8. The invention of claim 1, and a removable plug closing the rear end of the rear portion of said tube, said tube being of such length with respect to the length of said flashlight that a space for storage is provided between the removable plug and the rear of said flashlight.

9. The invention of claim 6, and a hollow extension connected to the rear end of said tube in lieu of said plug, said plug closing the rear end of said extension, said extension increasing the length of said baton and the storage space.

10. The invention of claim 1, and a relatively short side handle connected to the rear portion of said tube and extending outwardly substantially perpendicularly thereto.

11. A combination light and baton comprising an elongated tube of substantially uniform diameter, said tube having front and rear portions, said rear portion having a rotatably engagable portion extending axially from the front of said rear portion, said front portion having a rotatably engagable rear portion extending axially and adapted to engage the engagable front portion of said rear portion, whereby the front and rear portions of said tube may be rotatably assembled, a flashlight having a tubular body portion and a head received within said tube, said flashlight body being rotatable relative to its head in order to turn the flashlight off and on, bushing means receiving the body of said flashlight and abutting its head and engaging the tube's front portion to hold the flashlight head against movement relative to the front portion of said tube, means interengaging said flashlight tubular body and said rear portion of said tube in order to hold the body against movement relative to the rear portion of said tube, whereby relative rotation of said front and rear portions of said tube causes relative rotation between the flashlight body and head in order to turn the flashlight off and on.

* * * * *